US005429531A

United States Patent [19]

Oster

[11] Patent Number: 5,429,531

[45] **Date of Patent: * Jul. 4, 1995**

[54] HARD LEAD-ALLOY BATTERY CLAMP WITH TWO-WAY ACTION ARMATURES

[76] Inventor: Douglas D. Oster, 6655 Union Lake Trail, Lonsdale, Minn. 55406

[ * ] Notice: The portion of the term of this patent subsequent to Apr. 18, 2012 has been disclaimed.

[21] Appl. No.: 122,692

[22] Filed: Sep. 17, 1993

Related U.S. Application Data

[63] Continuation-in-part of Ser. No. 690,511, Apr. 24, 1991.

[51] Int. Cl.[6] ..... H01R 4/42

[52] U.S. Cl. ..... 439/762; 439/765

[58] Field of Search ..... 439/757, 758, 759, 761, 439/762, 765, 522, 3; 29/825

[56] References Cited

U.S. PATENT DOCUMENTS

| | | | |
|---|---|---|---|
| 1,845,089 | 2/1932 | Kionka . | |
| 2,049,649 | 8/1936 | Heitman . | |
| 2,057,542 | 10/1936 | Slavins . | |
| 2,086,048 | 7/1937 | Redinger | 439/758 O |
| 2,154,507 | 4/1939 | Hunefeld et al. . | |
| 2,247,452 | 7/1941 | Sells . | |
| 2,287,490 | 6/1942 | Tenney . | |
| 2,305,503 | 1/1950 | Tenney . | |
| 2,493,389 | 12/1951 | Casey . | |
| 2,577,714 | 12/1953 | Proff . | |
| 2,661,463 | 1/1956 | Johnson . | |
| 2,730,691 | 11/1958 | Nelson . | |
| 2,860,319 | 6/1965 | Short . | |
| 3,189,867 | 6/1965 | Kaashoek . | |
| 3,335,400 | 8/1967 | Johnson | 439/758 O |
| 3,359,534 | 12/1967 | Lewis et al. | 439/758 O |

FOREIGN PATENT DOCUMENTS

| | | | |
|---|---|---|---|
| 0764611 | 8/1967 | Canada . | |
| 2060218 | 10/1992 | Canada | 439/758 |
| 2606043 | 9/1976 | Germany . | |
| 3215524 | 11/1983 | Germany . | |
| 1404182 | 8/1975 | United Kingdom . | |

*Primary Examiner*—David L. Pirlot
*Assistant Examiner*—Daniel Wittels
*Attorney, Agent, or Firm*—Schwegman, Lundberg & Woessner

[57] ABSTRACT

Battery clamp including a nut molded into one of the clamping arms and a rotatable bolt with a flanged shaft molded into the other clamping arm. The head of the bolt, flange, and nut provide bearing surfaces for drawing the clamping arms together, or forcing the clamping arms apart, depending upon the rotation of the bolt. The battery clamp is manufactured in a single molding process by pre-threading the nut onto a treated or coated flanged bolt to a predetermined position, positioning the pre-threaded nut and bolt in one portion of a battery clamp mold, assembling the remaining pieces of the battery clamp mold around the bolt and nut, securing the pieces of the battery clamp mold together, pouring a hard lead-alloy into an opening in the battery clamp mold, quenching the lead filled mold in a liquid bath to accelerate the cooling process, separating the secured mold pieces after the lead-alloy cools, and removing the molded battery clamp. The flanged bolt is treated or coated with a non-stick material such as Teflon TM, graphite powder, or a non-petroleum based lubricant such as McLube TM.

9 Claims, 9 Drawing Sheets

FIG. 1
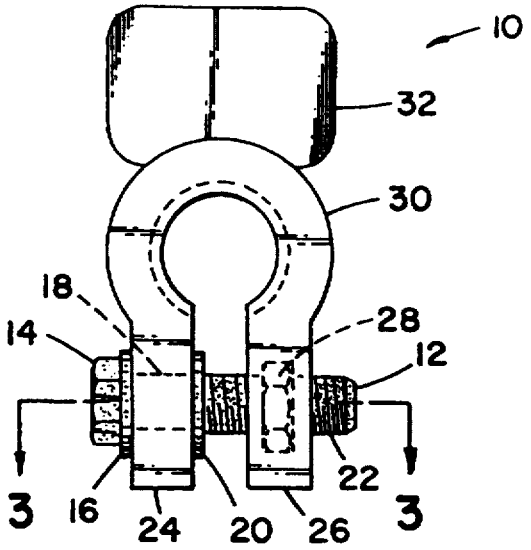
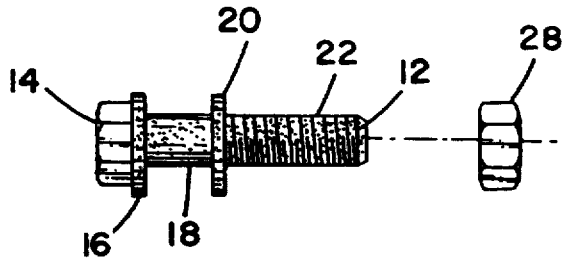
FIG. 2
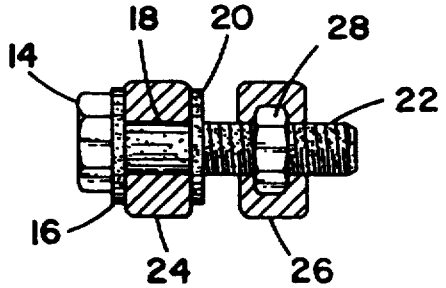
FIG. 3

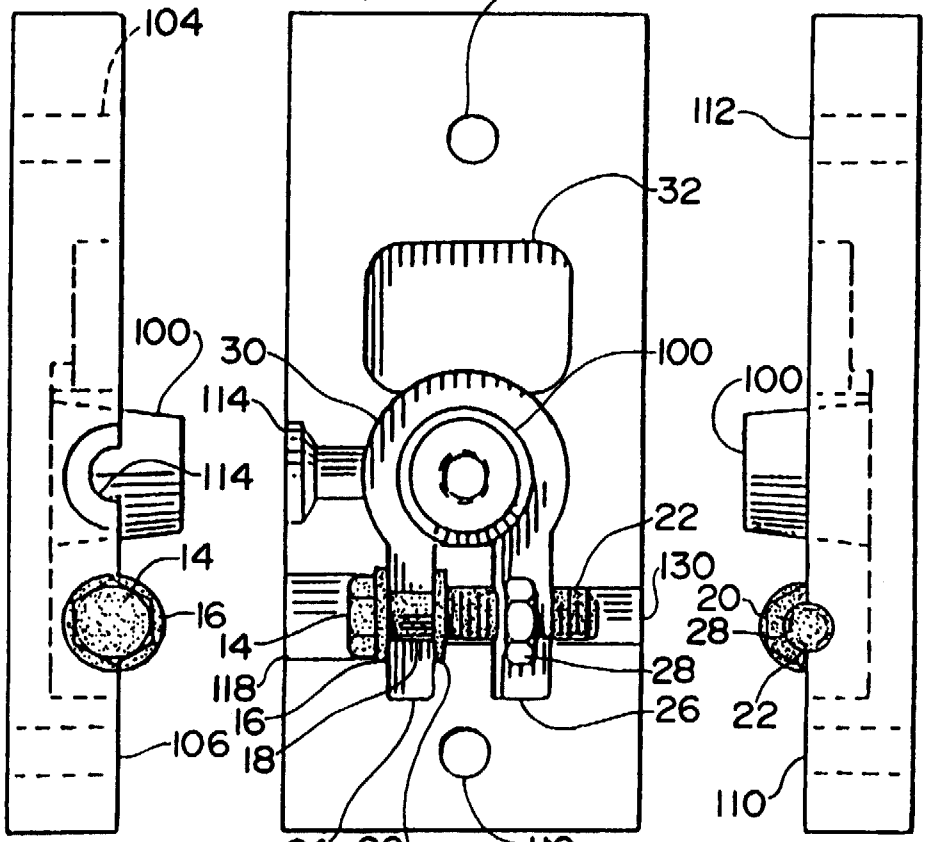
FIG. 14
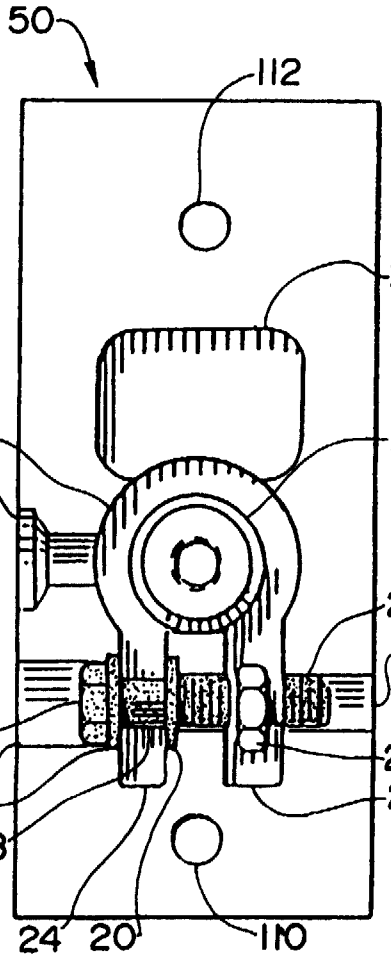
FIG. 13
FIG. 12
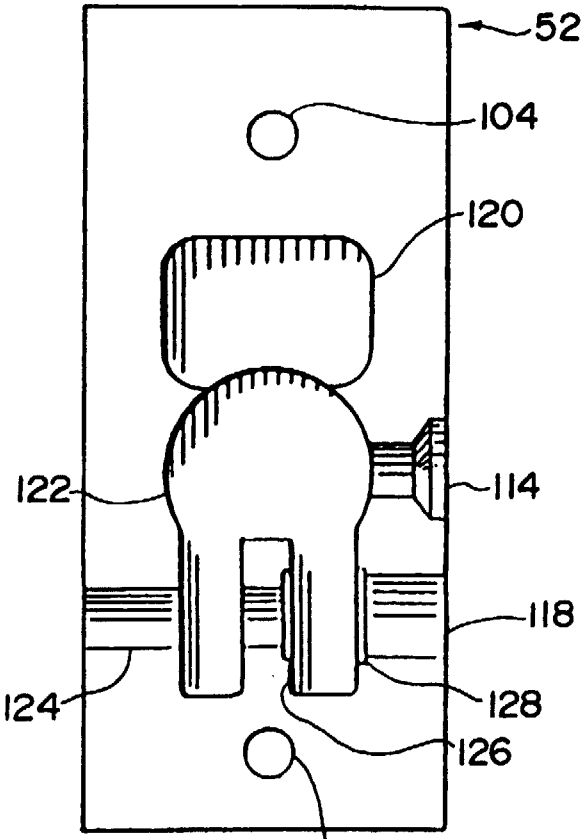
FIG. 11

HARD LEAD-ALLOY BATTERY CLAMP WITH TWO-WAY ACTION ARMATURES

CROSS REFERENCES TO RELATED APPLICATIONS

This application is a continuation-in-part of U.S. patent application, Ser. No. 07/690,511, filed Apr. 24, 1991, entitled BATTERY CLAMP AND PROCESS FOR MANUFACTURING SAME, by Douglas D. Oster.

BACKGROUND OF THE INVENTION

U.S. patent application Ser. No. 07/690,511, filed Apr. 24, 1991, and entitled BATTERY CLAMP AND PROCESS FOR MANUFACTURING SAME, by Douglas D. Oster, provides a battery clamp and method for manufacturing the same with an integral structure whereby the rotation of a steel bolt in one direction brings the clamping arms together and rotation in the other direction forces them apart. The invention solves the problem of prior art battery terminals which require that the clamping arms be pried apart in order to be removed. The invention features a low cost and efficient manufacturing process, which takes advantage of the low friction between lead materials and other harder metals, particularly steel. Because lead does not adhere to the bolt, the bolt and nut can be set in the clamping arms of the battery clamp when the clamp is cast.

It has been found, however, that when the clamp is constructed of certain lead-alloys, the steel bolt binds in the clamping arms and is difficult, if not impossible, to turn. However, harder lead-alloys are desirable or required for many applications, for example, for use on military vehicles.

SUMMARY OF THE INVENTION

The present invention is directed to a battery clamp with a nut and bolt structure which is molded into the clamp for pulling the clamping arms together and forcing the clamping arms apart, depending upon the direction of rotation of the bolt. The clamping arms of the battery clamp are cast around a flanged bolt with a pre-threaded nut so that one end of the bolt is cast into the other clamping arm, and the threaded end and nut is cast into the other clamping arm. The flanged bolt is treated or coated so that it does not bind to hard lead-alloys. The bolt may be coated with a non-stick composition such as a perfuoronated polymer. Alternatively, the bolt may be treated or coated with graphite, and in particular, may be coated with graphite powder. Non-petroleum based lubricants, such as MCLUBE TM (containing molybdenum disulfide, ethyl acetate, and carbon dioxide), may also be used to pre-treat the bolt before it is cast in place.

A significant aspect of the present invention is the method of casting the battery clamp using the technique discussed herein. The treated or coated bolt is positioned in the mold so that the pre-threaded nut is centered in the clamping arm indentation of the mold. The inner flange of the bolt can be positioned either adjacent to the clamping arm separation in the mold or in a recess within the clamping arm indentation. The pieces of the mold are secured together and a hardened lead-alloy material is poured in through an opening in the mold, thereby casting the lead alloy around the bolt and nut and thereby encapsulating them directly into the clamping arms of the battery clamp. Thus, the present invention provides a battery clamp constructed of a hard lead-alloy with an integral bolt having all the benefits of the battery clamp disclosed in U.S. application Ser. No. 07/690,511.

Having thus described the preferred embodiments of the present invention, it is a principal object hereof to provide a battery clamp and method for manufacturing the same in which a flanged bolt draws the clamping arms together or forces the arms apart depending upon the direction of rotation of the treated or coated bolt.

BRIEF DESCRIPTION OF THE DRAWINGS

FIG. 1 illustrates a top view of a battery clamp according to the present invention;

FIG. 2 illustrates an exploded view of a double flanged bolt and the nut;

FIG. 3 illustrates an end view of the battery clamp and the location at which the double flanged bolt is cast into the battery clamp arms;

FIG. 11 illustrates a top view of the bottom half of the mold of the preferred embodiment;

FIG. 12 illustrates a side view of the mold of the preferred embodiment;

FIG. 13 illustrates a top view of the bottom half of the mold, including the positioning of the double flanged bolt prior to casing;

FIG. 14 illustrates a side view of the left hand side of the bottom side of the mold;

DESCRIPTION OF THE PREFERRED EMBODIMENTS

Figure 4:
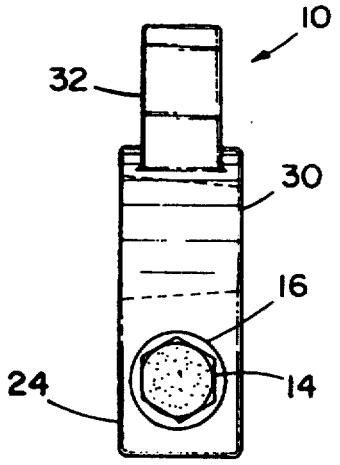
FIG. 4 illustrates a left side view of the molded battery clamp.

As noted in the background of the invention, when certain lead-alloys are used to form the clamp disclosed in U.S. patent application Ser. No. 07/690,511 (filed Apr. 24, 1991), the steel bolt either will not rotate or can only be rotated with considerable force. Military specifications require, for example, that battery clamps include at least seven percent antimony, which results in a particularly hard lead-alloy. Antimony percentages as low as two percent can also create a lead-alloy hard enough to inhibit the free rotation of a steel bolt cast in place in the clamp of application Ser. No. 07/690,511. The present invention solves this problem by providing that the steel bolt in any of the various embodiments shown herein in FIGS. 1–21A be either coated or pretreated with one of the following materials: (1) a baked-on non-stick surface such as Teflon TM or others from the class of the perfluoranated polymers; (2) wrapped with a non-stick material such as Teflon TM or others from the class of the perfluroanted polymers tape formed with a pufluoronated polymer; (3) pre-coated with graphite powder; (4) pre-coated with a non-petroleum based lubricant resistant to the temperature of a molten hard lead alloy such as MCLUBE TM (molybdenum disulfide, ethyl acetate, and carbon dioxide). MCLUBE TM is manufactured by McGee Industries, Inc., MCLUBE Division, Corzerville, Aston, Pa. 19014. In all of the above examples, the coated bolt or flange is steel or a steel alloy. Teflon TM coated bolts may be obtained from, for example, Sunbelt Coatings, 1805 West Detroit, Broken Arrow, Okla., 74012. Non-stick compositions, as referred to herein, comprise those from the class of perfluronated polymers, such as sold under the brand names Teflon TM and T-FAL TM. Preferably, the non-stick surfaces are baked on the bolts. Of critical importance is coverage of those surfaces of the bolt or the bolt flanges which come in contact with the lead-alloy in the clamp. Thus, although the bolts described hereinbelow with respect to the various embodiments of the invention are shown as coated or treated on all surfaces, such is not here understood as a necessity of the invention. For example, the bolt-heads need not be coated, except to the extent that a surface of such head may come in contact with the lead-alloy. As a practical matter, however, manufacturing is simplified if the entire bolt is either coated or treated.

Where graphite power is used, the bolt is preferably placed in a sealed container of graphite powder which is agitated until a coating of graphite powder is obtained on the bolt and its various surfaces. It may be preferable, although it is not necessary, to precoat the bolt with a sticky material in order to obtain better adherence of the graphite powder to the bolt. In the case of Teflon TM tape, the bolt and its various surfaces are wrapped with the tape. Where MCLUBE TM is used, it is simply sprayed over all surfaces of the bolt. No matter what coating or treatment is used, such coating or treatment is applied prior to the threading of the nut onto the bolt prior to casting of the clamp around the nut and bolt combination, which operation will be explained in more detail below. Throughout FIGS. 1–21A, the treatment or coating on the bolt is indicated by stippling. Described below are various alternate embodiments of the present invention, wherein a treated or coated bolt is employed with a hardened lead-alloy.

The battery clamp embodiments of the present invention are constructed of a hard lead-alloy. For military applications, the lead-alloy is substantially 7% antimony and 93% lead. A "hard" alloy, however, can be obtained with as little as 2% antimony, 98% lead. Other lead-alloy combinations may also be possible. For the purposes of the various embodiments of the invention, the critical measure of a "hard" lead-alloy is whether or not the lead-alloy binds the cast-in-place steel bolt. As used in this phrase, "bind" shall mean to prevent or substantially retard the rotation of the bolt when cast-in-place. Accordingly, as used herein and in the claims, the term "hard lead-alloy" shall mean a lead-alloy that is harder than plain lead, and that binds a steel bolt which is assembled into the clamp during the casting of the clamp. The term "steel bolt," as used in this definition, shall mean a steel bolt or a steel-alloy bolt with an untreated or uncoated surface.

FIG. 1 illustrates a top view of a battery clamp 10 including the coated or treated bolt 12. The head 14 and nut 28 cast directly into the clamping arms 24 and 26, respectively. The head 14 and outer flange 16 are adjacent to the outer side of clamping arm 24. The radial shaft 18 separates the outer flange 16 from the inner flange 20. The inner flange 20 is adjacent to the inner side of the clamping arm 24. The threaded shaft 22 passes through the clamping arm 26 and engages the nut 28. The arms 24 and 26, the connecting member 30, and the connecting plate 32 form a continuous piece of molded hard lead-alloy material.

FIG. 2 illustrates an exploded view of the coated or treated bolt 12 and the nut 28, where all numerals correspond to those elements previously described. The bolt and nut are of a standard configuration, commonly available from a numerous hardware suppliers. The bolt and nut of the present invention are constructed of a steel alloy. The bolt is coated or treated as noted above so that it does not adhere to the molten lead-alloy material. After the hard lead-alloy hardens, the treated or coated bolt turns freely in the lead-alloy material of the battery clamp. The inner flange 20 and outer flange 16, separated by the radial shaft 18, form bearing surfaces against the lead-alloy material of the clamping arm 24. When rotational force is applied to the head 14, the nut 28 remains stationary in the clamping arm 26.

FIG. 3 illustrates an end view of FIG. 1 where all numerals correspond to those elements previously described. This figure illustrates the position of the bolt 12 and the nut 28 in the clamping arms 24 and 26.

Figure 5:
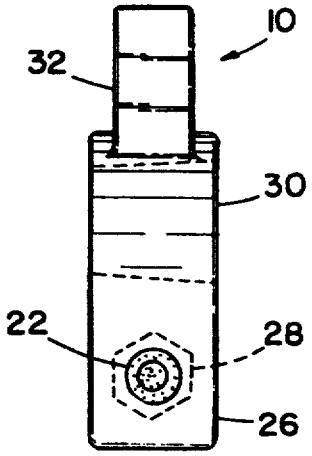
FIG. 5 illustrates a right side view of the molded battery clamp.
Figure 6:
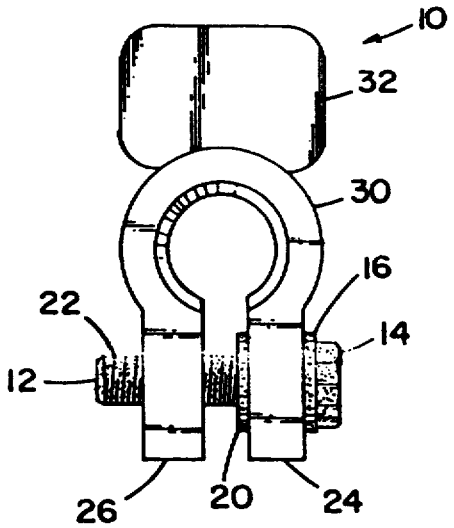
FIG. 6 illustrates a bottom view of the molded battery clamp.
Figure 7:
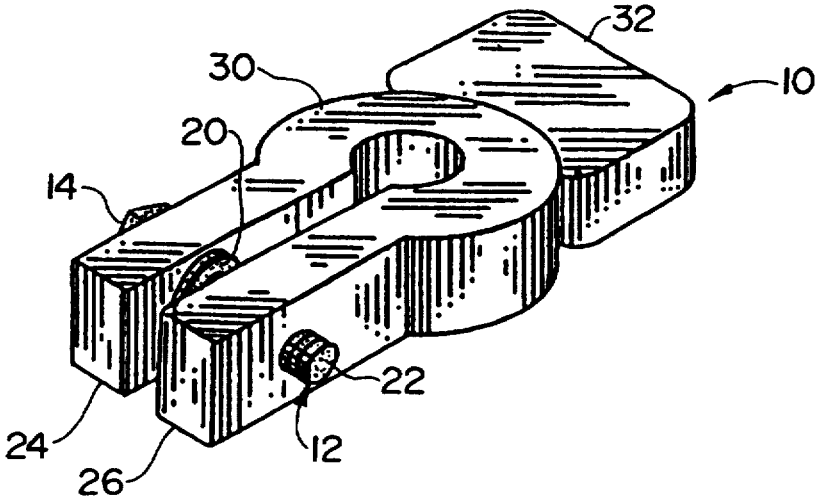
FIG. 7 illustrates a perspective view of the molded battery clamp.

FIG. 4 illustrates a left side view of the molded battery clamp 10, where the head 14 and the outer flange 16 are adjacent to arm 24. FIG. 5 illustrates a right side view of a battery clamp 10, where the threaded shaft 22 engages the nut 28, but rotates freely in the clamping arm 26. FIG. 6 illustrates a bottom view of the battery clamp 10. Finally, FIG. 7 illustrates a perspective view of the battery clamp 10 where all numerals correspond to those elements previously described.

Figure 8:
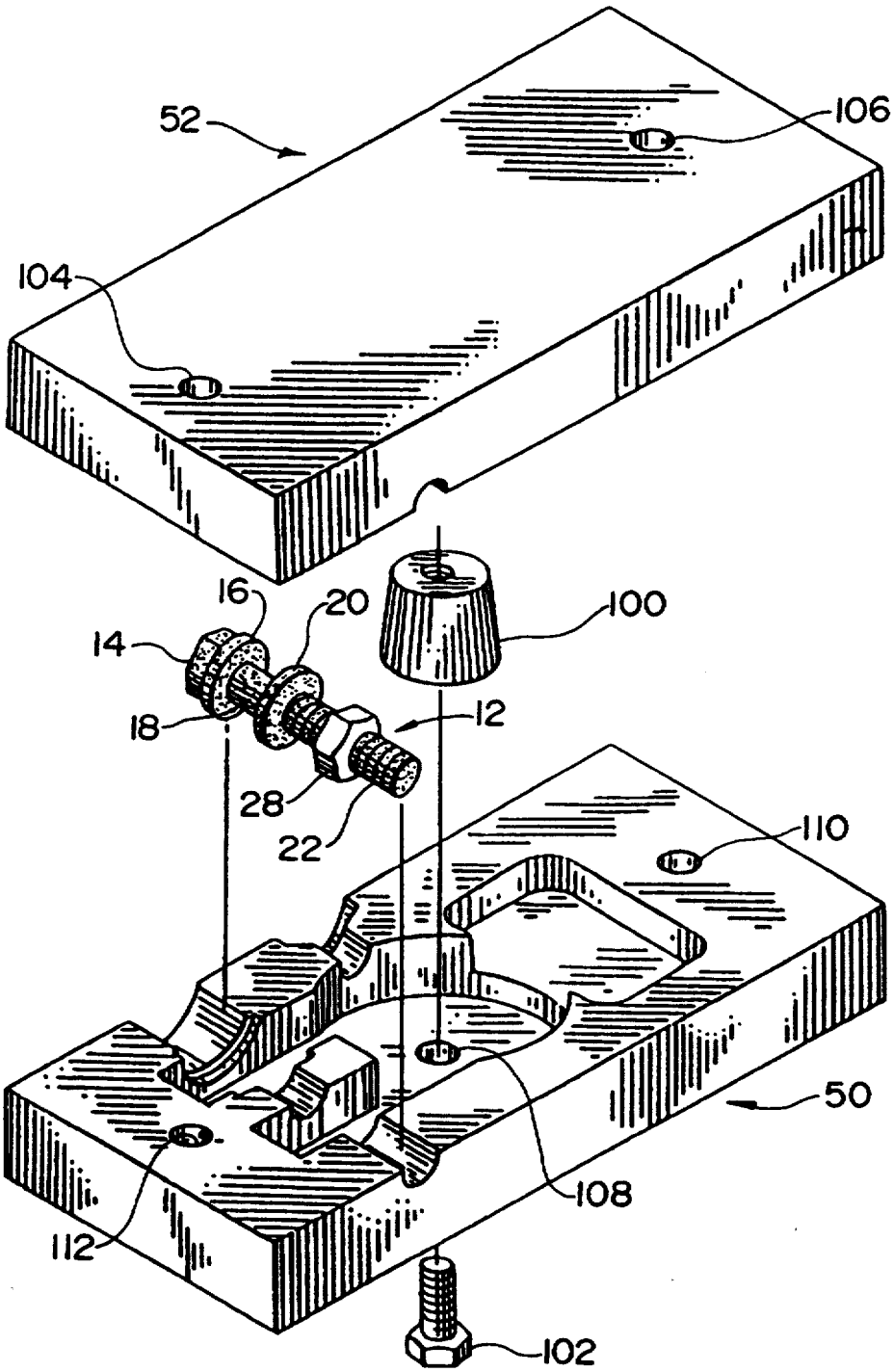
FIG. 8 illustrates an exploded perspective view of the mold of the preferred embodiment, including the flared battery post and nut, and the double flange bolt and nut.

FIG. 8 illustrates an exploded perspective view of the mold of the present invention, including a bottom mold half 50 and top mold half 52. The battery post mold insert 100 is attached to the bottom mold half 50 by the bolt 102, which passed through hold 108 in the mold. The molds 50 and 52 are secured together prior to pouring the hard lead-alloy via coated or treated bolts (not shown) which pass through holds 104 and 112, and 110 and 106 respectively.

Figure 9:
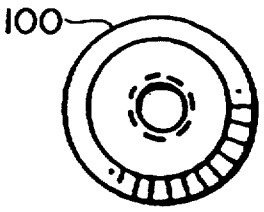
FIG. 9 illustrates a top view of the flared battery post.
Figure 10:
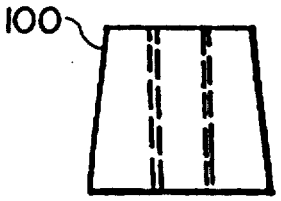
FIG. 10 illustrates a side view of the flared battery post.

FIG. 9 illustrates a top view of the flared battery post mold insert 100. FIG. 10 illustrates a side view of the flared battery post mold insert 100. Flaring the battery post aids in removing the molded battery clamp from the molds, as well as aiding in the installation and removal of the battery clamp from the battery terminal.

FIG. 11 illustrates a top view of the top mold half 52, showing the hole 114 for pouring the hard lead-alloy into the mold. The hard lead-alloy utilized by the Applicant to manufacture the battery clamp of the present invention was obtained by melting prior art battery clamps. However, it may be understood that a number of different hard lead-alloys may be used to practice the present invention.

Indentations 120 for the clamping area and 122 for the body of the clamp are shown. The mold includes the appropriate indentations 118 for the head of the bolt and 124 for the threaded shaft. The indentations for the bolt head and shaft continue through the end walls of the molds 50 and 52. Special recesses 126 and 128 are machined into the molds to accept the inner and outer flanges 20 and 16, respectively.

FIG. 12 illustrates a left side view of the bottom mold half 50 showing the hole 114 for pouring in the hard lead-alloy material. The head 14 of coated or treated bolt 12 and the outer flange 16 can be seen through the indentation 118. The flared battery post mold insert 100 is also shown.

FIG. 13 illustrates a top view of the bottom mold half 50 with the coated or treated bolt 12 and nut 28 positioned for casting. Also shown is the flared battery post 100 installed in bottom mold half 50. The coated or treated bolt 12 is located in the mold so that the inner flange 20 is inserted in recess 126 on the inner side of clamping arm 24. The outer flange 16 is inserted in the recess 128 on the outer side of clamping arm 24. The prethreaded nut 28 is positioned in the center of mold indentation for clamping arms 26. FIG. 14 illustrates a right side view of the bottom mold half 50 showing nut 28 and the end of the bolt 12 through indentation 124.

DESCRIPTION OF A FIRST ALTERNATIVE EMBODIMENT

Figure 15:
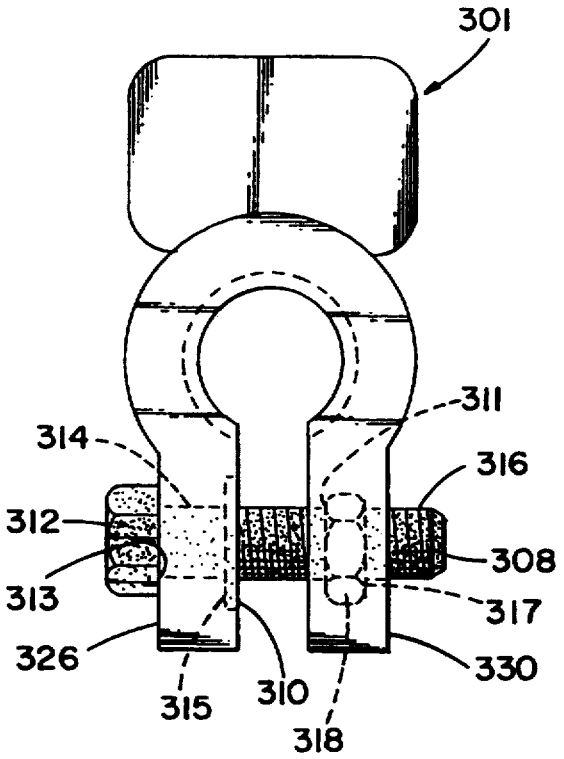
FIG. 15 illustrates a first alternative embodiment of a battery clamp utilizing a single flanged bolt with the inner flange cast adjacent to one of the clamping arm, forming a recess in the clamping arm.

FIG. 15 illustrates a first alternative embodiment of a battery clamp 301 including a coated or treated bolt 308 with a head 312, an inner flange 310 and a threaded shaft 316. The coated or treated bolt has a smooth radial shaft portion 314 between the head 312 and the inner flange 310. The inner flange 310 rotates freely in the clamping arm 326 when a rotational force is applied to the head 312. The threaded shaft 316 engages with the nut 318, which is embedded in the clamping arm 330.

The nut 318 is pre-threaded on the bolt 308 prior to casting and positioned in the center of the clamp arm 330. The inner flange 310 is positioned adjacent to clamping arms 330, forming a recess therein. The remaining configuration of the battery clamp is the same as that previously described.

In operation, a clockwise rotational force on the bolt 308 creates an inward force on the inner surface 313 of the head 312 against the lead-alloy material of the clamping arm 326. A corresponding inward force is created on the inner surface 311 of the nut 318, drawing the clamping arms together. When the coated or treated bolt 308 is turned counter-clockwise, an outward force is created on the outer surface 315 of the inner flange 310, which acts as a bearing surface against the lead-alloy material of the clamping arm 326. The rotation of the coated or treated bolt 308 creates a corresponding outward force on the outer surface 317 of the nut 318, forcing the clamping arms apart.

Figure 16:
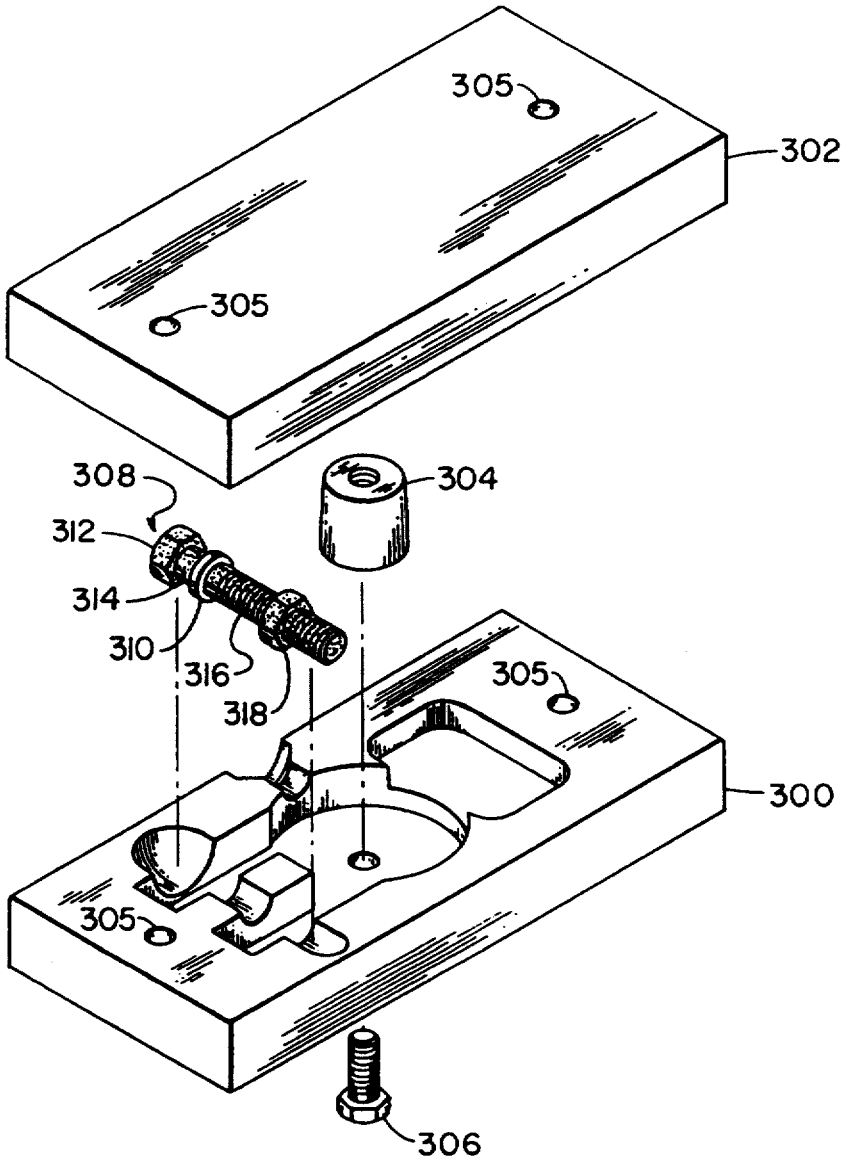
FIG. 16 illustrates an exploded perspective view of the mold of the first alternative embodiment, including the flared battery post and nut, and the single flange bolt and nut.

FIG. 16 illustrates an exploded perspective view of the mold in a first preferred embodiment of the present invention. The bottom mold half 300 and top mold half 302 are held together by bolts (not shown) passing through mold bolt holes 305. The battery post molding 304 is secured to the bottom mold half 300 by the battery post bolt 306.

The coated or treated bolt 308 contains a single inner flange 310, separated from the head 312 by a smooth radial shaft 314. The threaded shaft 316 and nut 318 are substantially the same as previously discussed.

Figure 17:
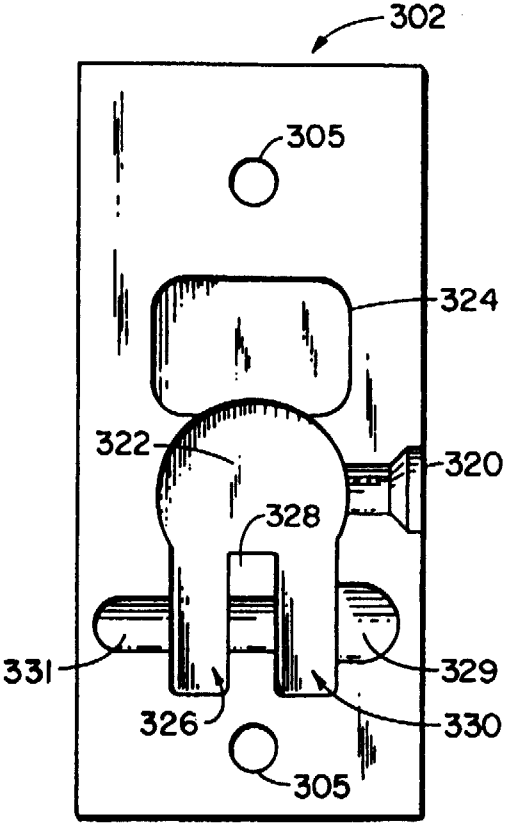
FIG. 17 illustrates a top view of the bottom half of the mold of the first alternative embodiment.

FIG. 17 illustrates a top view of the top mold half 300. A pouring hole 320 for pouring the lead-alloy into the mold is provided. The mold includes three primary indentations for the body of the clamp 322, the clamping area 324, and the clamping arms 326 and 330. The clamping arm separator 328 portion of the mold is interposed between the clamping arm indentations 326 and 330. Contrary to the preferred embodiment, the indentations for the bolt head 329 and the shaft 331 do not continue through the end walls of the molds 300 and 302.

Figure 19:
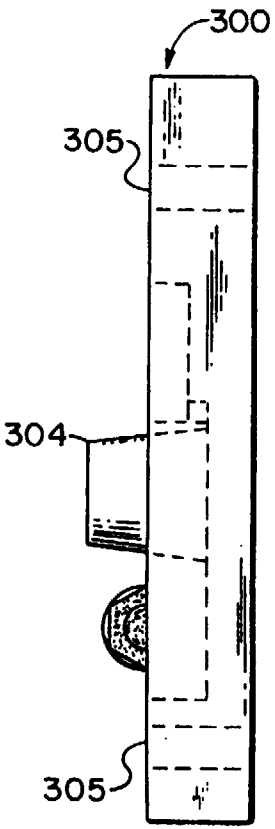
FIG. 19 illustrates a side view of the left hand side of the bottom side of the mold.
Figure 18:
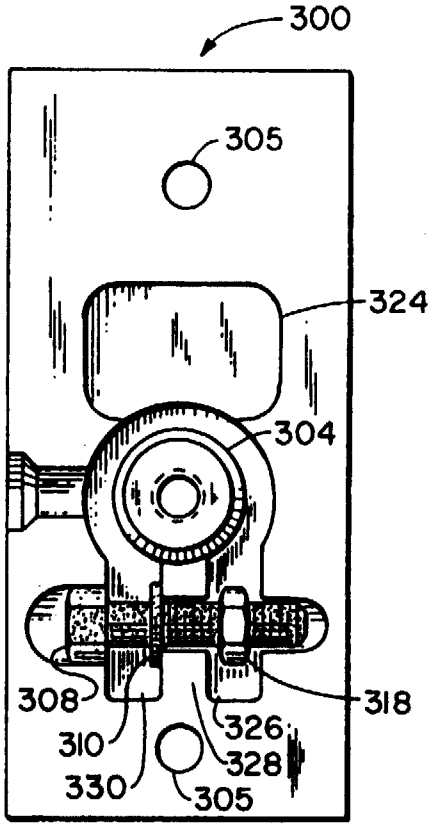
FIG. 18 illustrates a top view of the bottom half of the mold, including the positioning of the single flanged bolt prior to casing.

FIG. 18 illustrates a top view of the bottom mold half 300 with the coated or treated bolt 308, nut 318 and battery post mold insert 304 positioned for casting. The coated or treated bolt 308 is positioned in the mold so that the inner flange 310 is adjacent to the clamping arm separator 328. The nut 318 is pre-threaded on the bolt 308 and positioned in the mold approximately in the center of the clamping arm indentation 326. FIG. 19 illustrates a right side view of the bottom mold half 300 showing nut 318 and battery post 304.

Figure 20:
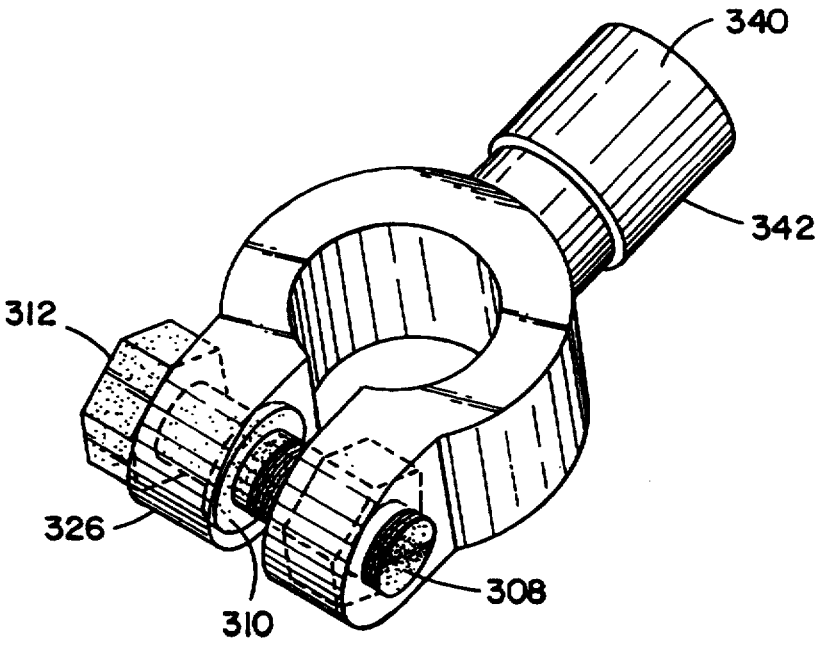
FIG. 20 is a perspective view of the battery clamp of the first alternative embodiment with an cylindrically shaped connecting member.

FIG. 20 illustrates an alternative battery clamp configuration. The battery clamp 340 is molded with a tubular shaped wire clamping member 342, whereby the wire to be attached to the battery clamp (not shown) is inserted into the tubular clamp and the clamp member 342 is compressed.

Figure 21:
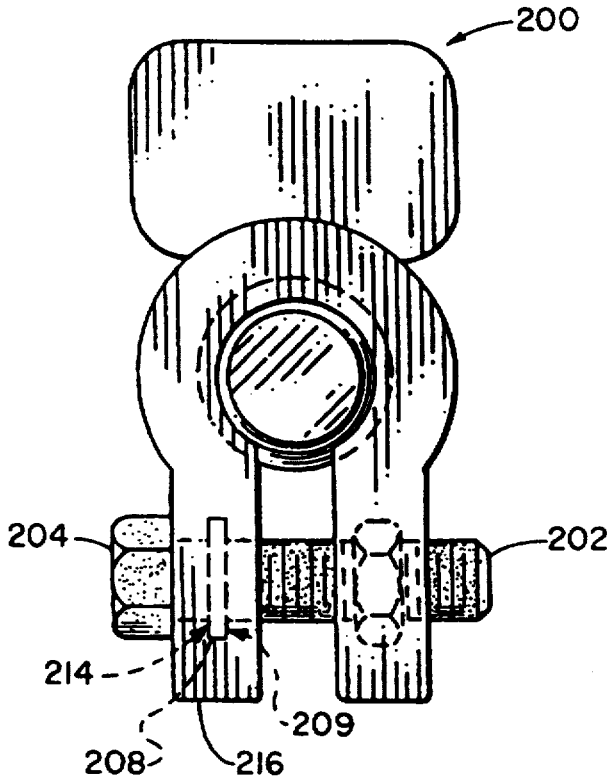
FIG. 21 illustrates a top view of another alternative embodiment where the flange is located in the interior of the clamping arm.
Figure 21A:
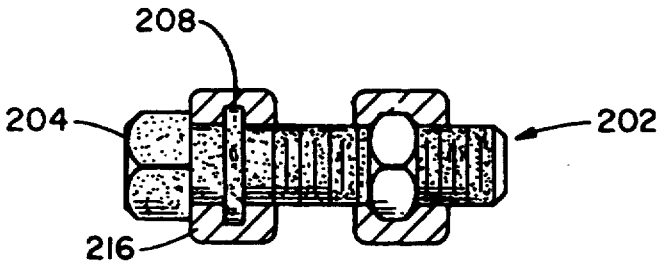
FIG. 21A illustrates an end view of the alternative embodiment of FIG. 20.

FIGS. 21 and 21A show yet another alternative embodiment of battery clamp 200 wherein coated or treated bolt 202 includes a flange 208 with an outside bearing surface 214 and an inside bearing surface 209, which surface operates to retain coated or treated bolt 202 in place relative to clamping arm 216. Head 204, although shown adjacent to surface of armature 216, may be spaced apart from that surface if desired.

METHOD OF MANUFACTURE

The method of manufacture of the present invention comprises the following steps: 1) coating or treating the flanged bolt as noted hereinabove; 2) pre-threading the nut onto the treated or coated flanged bolt to a predetermined position; 3) positioning the bolt and nut in one half of the mold as shown for example in FIG. 18; 4) securing both halves of the mold together with a bolt and nut combination; 5) pouring a hard lead-alloy material into an opening in the mold; 6) quenching the hard lead-alloy-filled mold in a liquid bath to accelerate the cooling process; and 6) after cooling, separating the mold pieces and removing the molded battery clamp. Because the hard lead-alloy material does not adhere to the coated or treated steel bolt, the bolt turns freely to open and close the clamping arms of the battery clamp.

While particular embodiments have been described, it will be appreciated that modifications can be made without departing from the scope of the invention as defined by the appended claims. For example, a threaded insert may be substituted for the bolt and nut combination.

I claim:

1. A battery clamp, comprising:

a steel bolt having a threaded shaft and first and second ends, a head on the first end and one or more stop members formed integrally with the bolt and positioned proximate the first end, the threads on the shaft beginning on the second end and extending toward the first end, the one or more stop members each having at least one stop-surface;

a nut threaded on the bolt in a position proximate the second end of the bolt;

a one-piece cast hard lead-alloy clamp member having first and second opposing armatures;

the first armature formed around the shaft of the bolt proximate the first end so that (i) the head of the bolt is external to the clamp member;

(ii) at least one of the stop-surfaces bears against a surface of the first armature having a component facing the second end of the bolt;

(iii) at least one of the stop-surfaces or a surface of the head bears against a surface of the first armature having a component facing the first end of the bolt;

(iv) whereby the first end of the bolt is axially fixed in position relative to the first armature;

the second armature formed around the threaded shaft of the bolt so that the nut is enclosed in the second armature and so that the nut is axially and rotatably fixed in position; and the surfaces of the bolt in contact with the hard lead-alloy of the clamp member coated with a non-petroleum based lubricant resistant to temperatures in the range of the molten state of the hard lead-alloy.

2. A clamp according to claim 1 wherein the hard lead-alloy is substantially 2–7% antimony and 98–93% lead, respectively.

3. A clamp according to claim 1 further wherein there is a single stop member having two oppositely facing stop-surfaces, and wherein each of the oppositely facing stop-surfaces engages a surface of the first armature enclosed in the first armature.

4. A clamp according to claim 1 further wherein there is a single stop member having two oppositely facing stop-surfaces, one of the two oppositely facing stop-surfaces engaging a surface of the first armature having a component facing the second armature, and the other of the stop-surfaces facing the second armature and not enclosed in the second armature.

5. A clamp according to claim 4 further wherein a surface of the bolt having a component facing the first armature engages a surface of the first armature facing away from the second armature.

6. A clamp according to claim 1, 2, 3, 4 or 5 wherein the non-petroleum based lubricant is a non-stick surface composition from a class of perfluoronated polymers.

7. A clamp according to claim 1, 2, 3, 4 or 5 wherein the non-petroleum based lubricant is graphite.

8. A clamp according to claim 1, 2, 3, 4 or 5 wherein the non-petroleum based lubricant is a composition including molybdenum disulfide, ethyl acetate and carbon dioxide.

9. A clamp according to claim 6 wherein the perfluoronated polymer is a perfluoro-polyolefin.

* * * * *